US009286813B2

(12) United States Patent
Fakhari et al.

(10) Patent No.: US 9,286,813 B2
(45) Date of Patent: Mar. 15, 2016

(54) COMPOSITE STREET SIGN WITH INTEGRAL ELECTRICAL WIRING

(71) Applicant: ALF Operating Partner LP, Fort Worth, TX (US)

(72) Inventors: M. John Fakhari, Fort Worth, TX (US); A. Lee Finley, Fort Worth, TX (US); Adam R. Fakhari, Fort Worth, TX (US)

(73) Assignee: ALF OPERATING PARTNERS, LTD., Fort Worth, TX (US)

( * ) Notice: Subject to any disclaimer, the term of this patent is extended or adjusted under 35 U.S.C. 154(b) by 0 days.

(21) Appl. No.: 14/496,325

(22) Filed: Sep. 25, 2014

(65) Prior Publication Data

US 2015/0089849 A1 Apr. 2, 2015

Related U.S. Application Data

(60) Provisional application No. 61/883,502, filed on Sep. 27, 2013.

(51) Int. Cl.

| | |
|---|---|
| ***G09F 13/00*** | (2006.01) |
| ***G09F 13/02*** | (2006.01) |
| ***G09F 13/18*** | (2006.01) |
| ***E01F 9/016*** | (2006.01) |

(52) U.S. Cl.
CPC ..... *G09F 13/02* (2013.01); *E01F 9/016* (2013.01); *G09F 13/18* (2013.01)

(58) Field of Classification Search
CPC ..... G09F 13/00
USPC ..... 40/541, 550; 362/183
See application file for complete search history.

(56) References Cited

U.S. PATENT DOCUMENTS

| | | | | |
|---|---|---|---|---|
| D276,736 | S * | 12/1984 | Maya | D20/17 |
| 4,537,806 | A * | 8/1985 | Sherrard | A47G 33/06 362/806 |
| 4,920,467 | A * | 4/1990 | Honsberger | 362/658 |
| 5,010,463 | A * | 4/1991 | Ross | 362/253 |
| 5,062,028 | A * | 10/1991 | Frost et al. | 362/183 |
| 6,058,634 | A * | 5/2000 | McSpiritt | 40/452 |
| 6,588,732 | B1 | 7/2003 | Caceres et al. | |
| 7,322,564 | B2 | 1/2008 | Fakhari | |
| 7,665,883 | B2 * | 2/2010 | Matheson | 362/652 |
| 7,810,277 | B2 * | 10/2010 | Fakhari | A01G 1/08 362/152 |
| 7,937,868 | B2 | 5/2011 | Gallet | |
| 8,354,048 | B2 | 1/2013 | Caceres et al. | |

(Continued)

FOREIGN PATENT DOCUMENTS

CN 202108010 U * 1/2012

OTHER PUBLICATIONS

SOLLITECH product circular for solar signs, believed to have been published more than one year prior Sep. 27, 2013; published at: http://issuu.com/ramibisher/docs/full_catalog1.

*Primary Examiner* — Cassandra Davis
(74) *Attorney, Agent, or Firm* — Erickson Kernell Derusseau & Kleypas, LLC

(57) ABSTRACT

A street sign fabricated from a composite material having at least on panel for displaying indicia such as street names. Electrical conductors may be embedded into the panel to permit attachment and electrical coupling of lights and other electrical devices thereto. A battery may be installed in a hollow post supporting the panel to provide power to the electrical devices. The battery can be recharged using a solar panel mounted proximate the top of the sign.

2 Claims, 5 Drawing Sheets

(56) References Cited

U.S. PATENT DOCUMENTS 8,390,184 B2 * 3/2013 Pet et al. ..... 313/317
2008/0217597 A1 * 9/2008 Foster ..... 256/10
2010/0031546 A1 * 2/2010 Nwatu ..... G09F 15/0062 40/607.1
2015/0033605 A1 * 2/2015 Grush ..... 40/607.05

* cited by examiner 24
81
1
3.-1
16
8
51
MAIN ST
16
33
52
KATT ST
30
5
48
50
46
8

3.-1
28
24
27
69
76
5
75

113
74
70
115
115
31
124
101
115
56
72
102
117
115
68
52
55
118
18
51
8
49
K
8
60
47
67
55
52
56
50
27

Fig. 10.
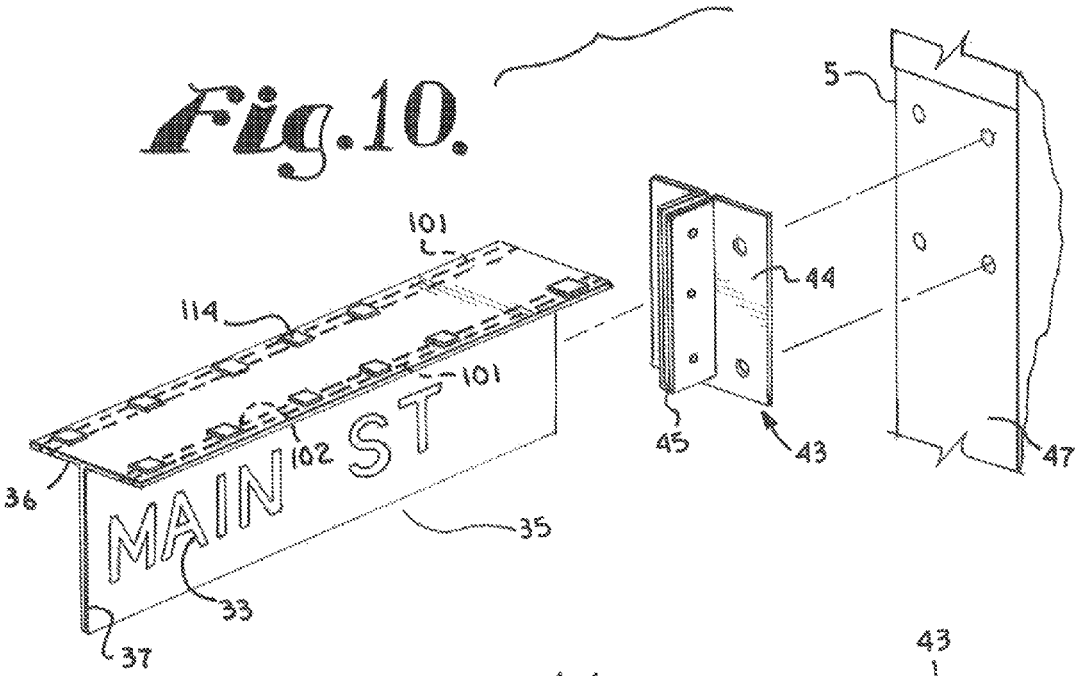
Fig. 11.
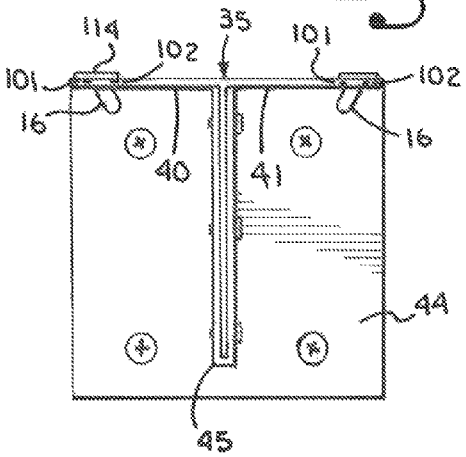
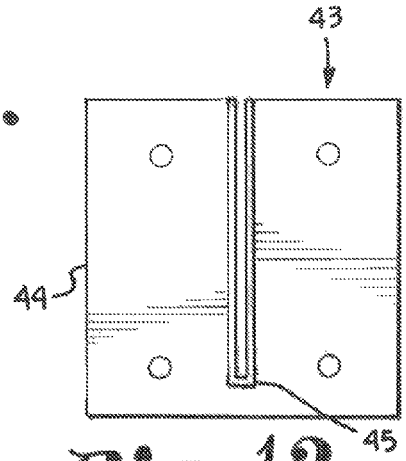
Fig. 12

COMPOSITE STREET SIGN WITH INTEGRAL ELECTRICAL WIRING

CROSS-REFERENCE TO RELATED APPLICATIONS

This application claims the benefit of U.S. provisional patent application Ser. No. 61/883,502, filed Sep. 27, 2013, under 35 U.S.C. §119(e).

BACKGROUND OF THE INVENTION

1. Field of the Invention

This invention relates to street signs. More specifically, street signs made from a composite material and having an integral electrical system.

2. Background & Description of the Related Art

Street signs or street name signs usually consist of rectangular panels mounted on a vertical post, each panel having a street name, either in full or a variation thereof, printed on at least one side of the panel. The sign panels may also have graphics or other ancillary notations printed on them. Street signs are commonly found at street intersections and may share mounting posts with traffic signs such as stop signs.

Street signs are often constructed of metal to provide the strength and durability necessary to withstand harsh outdoor weather conditions. Specifically, the panels are usually made out of painted aluminum and the post from painted or unpainted aluminum or steel. However, use of aluminum for street sign panels has certain drawbacks when compared to other materials. Drawbacks include increased risk of theft due to the material value, glare from unpainted or chipped surfaces, and maintenance costs. Because of these concerns, fiber reinforced polymer (also called fiber reinforced plastic) has become a popular alternative material for fabricating street sign panels.

Fiber reinforced polymer (FRP) is a durable composite material comprising a polymer material reinforced by glass, carbon, aramid or other types of fibers. FRP products are formed using a variety of manufacturing methods including a pultrusion process. Pultrusion involves pulling reinforcing fibers or matting through a vat of resin and then through a heated die where the resin undergoes polymerization encasing the fibers.

A problem with many of the street signs made and used today, whether they are made of aluminum, FRP, or some other material, is that they are difficult to read in the dark, specifically at night. For this reason street signs typically use reflective material to make their words or graphics more visible in the dark. This can be done by adding reflective vinyl or reflective paint with glass beads to the sign panels.

Relying solely on reflectivity to make a street sign visible in the dark has an obvious and significant drawback, which is that an exterior light source is required to activate the reflective element and make the sign visible. Not only must there be an exterior light source but the light must be directed at the sign and the light must be of sufficient intensity to be reflected off of the sign. There are situations where this type of light may not be available, for example pedestrians walking without a light source or inclement weather such as rain causing the intensity of light hitting the sign to decrease due to refraction by the raindrops.

What is needed in the industry is a street sign made of durable material such as FRP having an integral means for illuminating the indicia on the sign. It is known in the art to mount LED lights to a traffic sign in a manner that overlaps the sign's indicia so that the lights outline or form the shape of the indicia. A company named Sollitech (www.sollitech.com) located in Amman, Jordan currently manufactures such a product. A problem with using lights to form the shape of the indicia rather than illuminating the indicia is that characteristics of the indicia such as color will not appreciable in the dark. A better method of using lights on a sign would be to illuminate indicia with lights set away from the indicia. Also, the lights in the Sollitech signs overlay the indicia, which detracts from the aesthetics of the sign during the daytime. What is needed is a durable street sign having integral lighting that illuminates indicia rather than simply outlining or forming the shape of the indicia.

SUMMARY OF THE INVENTION

The present invention is directed to a sign fabricated from a composite material such as fiber reinforced polymer or fiberglass. The sign has at least one panel for displaying indicia such as street names, the indicia being displayed on either the front surface or back surface of the panel. The panel has a pair of electrical conductors embedded therein between the front surface and back surface that can be used to supply electricity to lights or other electrically powered devices attached to the panel. The conductors may be routed above the indicia and run continuously along the length of the panel, and accordingly lights being fed electricity from the conductors may be positioned above indicia along the length of the panel. The sign may further comprise a post for supporting the panel. A battery for providing electrical power to the electrically powered devices may be stored within the post and a solar panel may be mounted proximate the top of the post for recharging the battery.

A light that is securable to the panel may comprise a light socket body with a plug projecting from an opposite end thereof. A socket may be formed in the light socket body and a light source positioned in the socket with a pair of electrical leads extending through the light socket body and plug. The plug could be inserted through a hole in the panel such that the electrical leads are held in contact with exposed portions of the electrical conductors. When inserted in the hole, the plug would extend beyond the panel and a cap sized to be wider than the hole would be secured on the plug holding the light to the panel. Lights can be mounted in a row above indicia on the panel and the lights may project from either side of the panel to illuminate either or both sides of the panel. Also, lights may be angled toward the indicia being illuminated.

BRIEF DESCRIPTION OF THE DRAWINGS

FIG. 10 is a fragmentary, exploded perspective view of the embodiment of the street sign shown in FIG. 8 having a T-shaped sign panel secured to the post by a bracket.

FIG. 11 is a fragmentary, end view of the street sign shown in FIG. 8.

FIG. 12 is an end view of the bracket for mounting the T-shaped sign panel to a post.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to the installed position of the item to which the reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Figure 1:
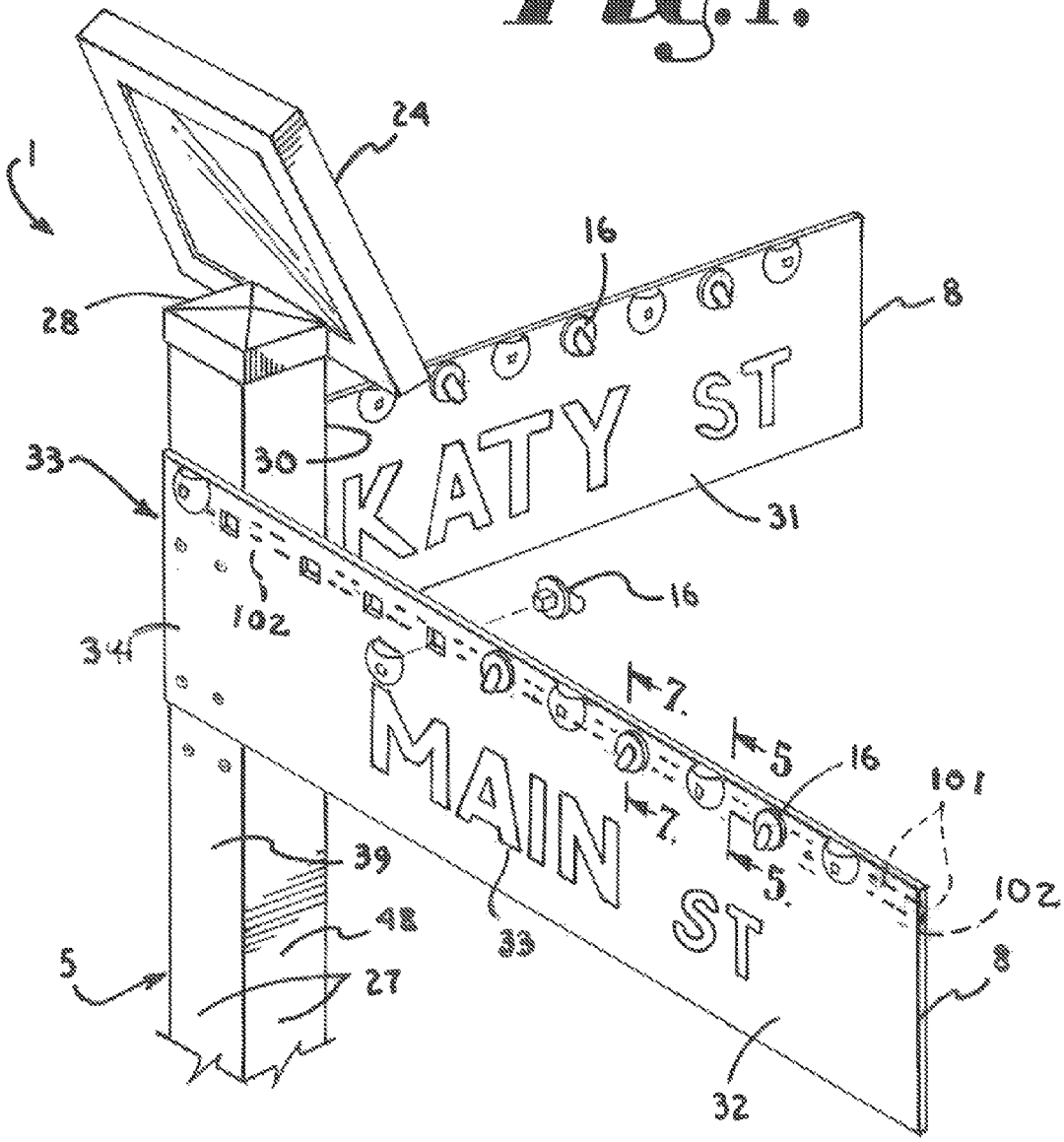
FIG. 1 is a perspective view showing the back of a street sign made of composite material.

Referring to the drawings in more detail, reference numeral 1 refers to a street sign with FIG. 1 showing a perspective view of the back of the sign. The sign 1 comprises a vertical post 5 and display panels 8 attached to the post. Sign 1 further comprises electrical conductors 101 and 102 embedded within each panel 8 to serve electrically powered devices such as lights 16 attached to each panel. Finally, a battery 18 is located within post 5 for powering the electrical devices. The battery is charged by solar panel 24 mounted near the top of post 5.

In the embodiment shown, post 5 is constructed of fiber reinforced polymer (FRP) or resin, which is occasionally referred to as fiberglass. Post 5 has a cross section of approximately four inches by four inches and the post is generally hollow. The height of post 5 depends on the location of the sign but a height of eight feet is typical. Post 5 must be sufficiently durable to withstand wear and tear that may be caused by weather, pedestrians or machines such as lawn mowers. Accordingly, the walls 27 of post 5 are approximately one quarter inch thick, which results in sufficient strength and durability for most applications. The wall thickness can be modified as necessary to provide durability based on the sign's environment and use. Post 5 forms the support structure for sign 1 and for a typical installation post 5 is oriented vertically and its lower end (not shown) is anchored in the ground. The lower end is usually buried at a depth of at least two feet but site conditions will dictate the appropriate depth. Also, some installations require the lower end of post 5 to be embedded in concrete within the ground for stability such as when the ground is soft or sandy. Also, post 5 may be anchored entirely in concrete instead of dirt in situations where concrete is the only surface available for mounting such as urban street corners. Post 5 has a peaked cap 28 covering its top to prevent precipitation from accumulating atop the post. It is foreseen that other cap shapes such as domes or spheres could also be used for aesthetic reasons.

Attached to post 5 proximate its upper end 30 are first and second vertical display panels 8 extending in perpendicular alignment. Panel 8 has a front surface 31 and a back surface 32 and indicia 33 such as street names printed on either or both surfaces 31 and 32 of the panel 8 as appropriate. There are two panels 8 shown in FIGS. 1 and 2, but any number of panels 8 may be used. Each panel 8 is constructed of FRP or fiberglass. In a preferred embodiment, post 5 and panel 8 are both formed through a pultrusion process. In a pultrusion process reinforcing fibers or matting are pulled through a vat of resin and then through a heated die where the resin undergoes polymerization. The pultruded post 5 or panel 8 can then be cut to any desired length.

Figure 2:
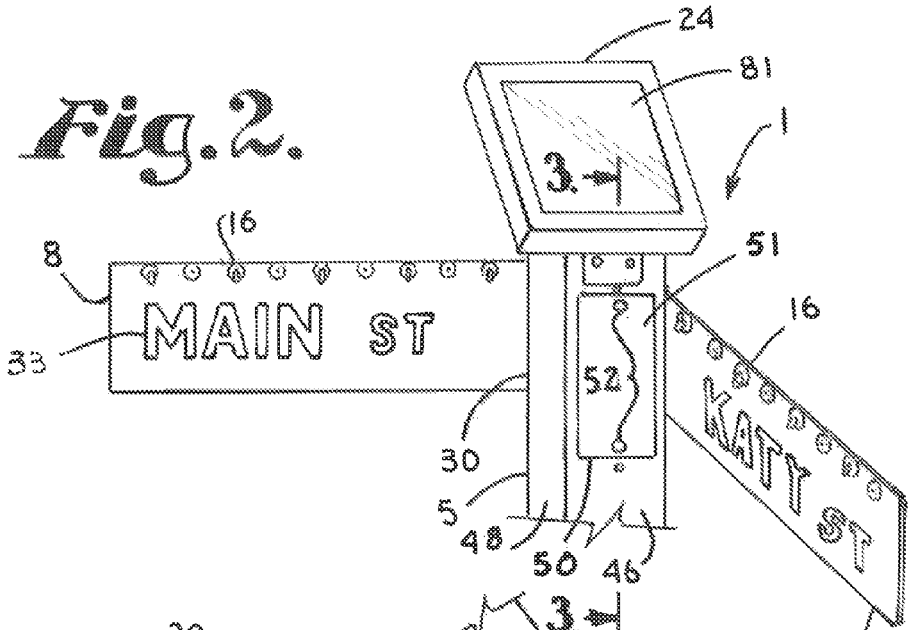
FIG. 2 is a front perspective view of the sign in FIG. 1.

As shown in FIGS. 1 and 2, each panel 8 is rectangular in shape with dimensions of approximately five inches tall, twenty four inches wide, and one eighth of an inch thick. Panel 8 is attached to post 5 by riveting the panel's mounting end 34 to post 5 using rivets. Prior to riveting panel 8 to the post, four rivet holes (not shown) are drilled in the mounting end 34. A corresponding set of four rivet holes (not shown) are drilled in the upper end 30 of post 5. Panel 8 is attached to post 5 by aligning the rivet holes on panel 8 with those on post 5 and inserting and upsetting a rivet in each hole. It is foreseen that a different quantity and configuration of rivets may be used to attach a panel 8 depending on the specific physical characteristics of post 5 and panel 8.

Figure 8:
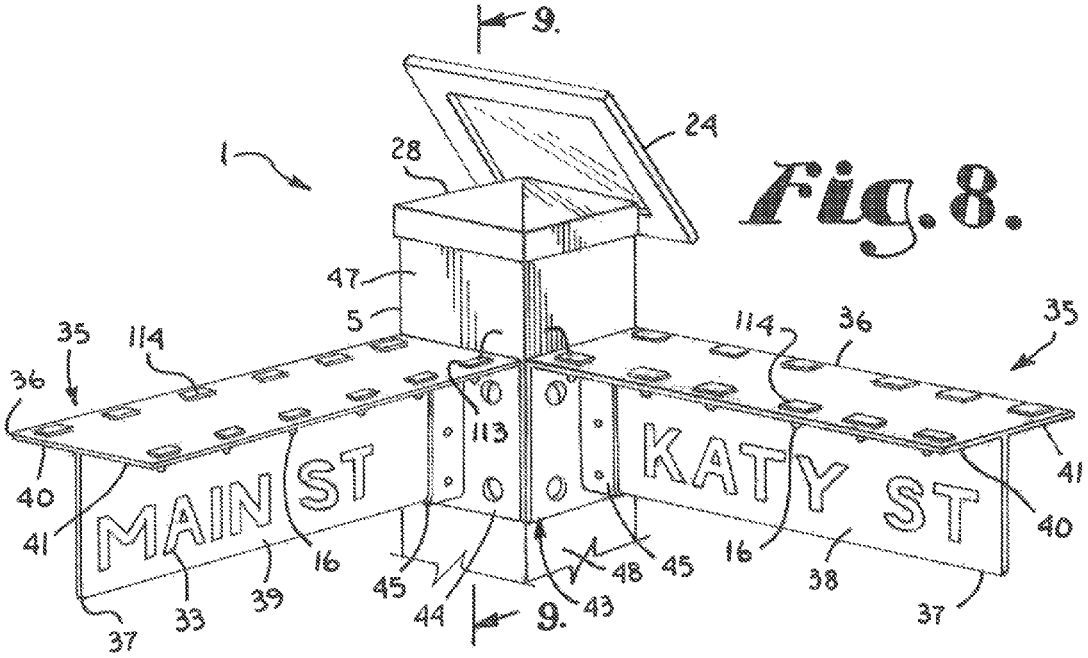
FIG. 8 is a perspective view showing of an alternate embodiment of the street sign in FIG. 1.
Figure 9:
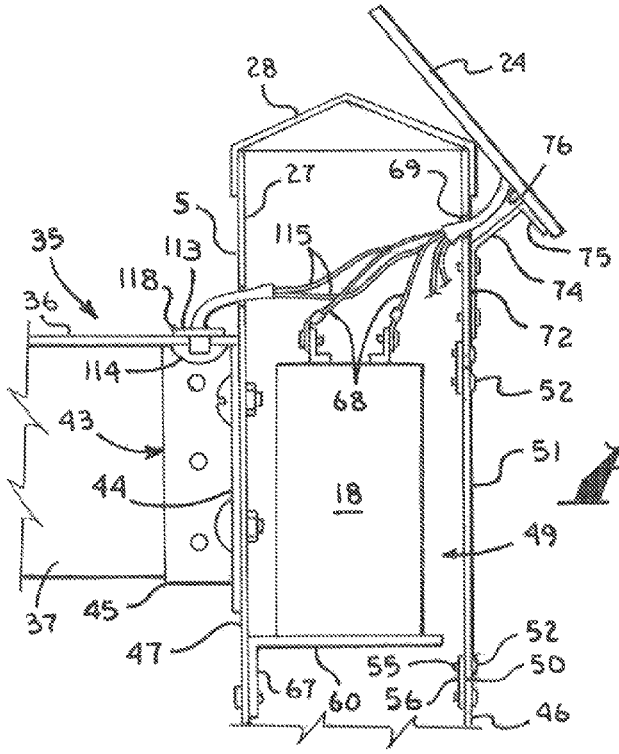
FIG. 9 is a cross-sectional view of the post taken along line 9-9 of FIG. 8.

Alternatively, as shown in FIGS. 8 and 9, sign 1*a* may comprise one or more t-shaped displays or panel assemblies 35 for displaying indicia. Each display 35 has a rectangular top panel 36 oriented in a horizontal planar fashion. A downwardly extending rectangular vertical panel 37 is attached to the bottom of top panel 36. Vertical panel 37 is generally perpendicular to and extends centrally relative to top panel 36. In the embodiment shown, vertical panel 37 is located proximate the longitudinal centerline of top panel 36. It is foreseen that panel 37 could be attached to top panel 36 in other locations including an edge of top panel 36. Top panel 36 is configured to overhang or project away at least one face 38 of vertical panel 37. As shown herein, top panel 36 overhangs both faces 38 and 39 of vertical panel 37 forming first and second overhangs 40 and 41. The overhangs 40 and 41 are adapted for connecting lights thereto to illuminate the faces 38 and 39 of vertical panel 37 as will be discussed in more detail hereafter. In a preferred embodiment, vertical panel 37 and top panel 36 are formed from a fiber reinforced polymer or fiberglass and formed from a pultrusion process as a single integral member having a t-shaped cross section. It is foreseen that the panels may be fabricated from other materials and may be formed separately and various methods may be used for securing the panels together.

Display 35 is attached to post 5 using mounting bracket 43. Bracket 43 includes a mounting flange 44 and a u-shaped support 45 attached to the outer face of mounting flange 440. Bracket 43 is secured to post 5 by fastening mounting flange 44 to the wall of the post using bolts or similar fasteners. An end of vertical panel 37 is placed in support 45 and secured to the support 45 using rivets or the like. When installed, display 35 extends from post 5 in a cantilevered fashion. Bracket 43 may be constructed of FRP or fiberglass or other materials.

Figure 3:
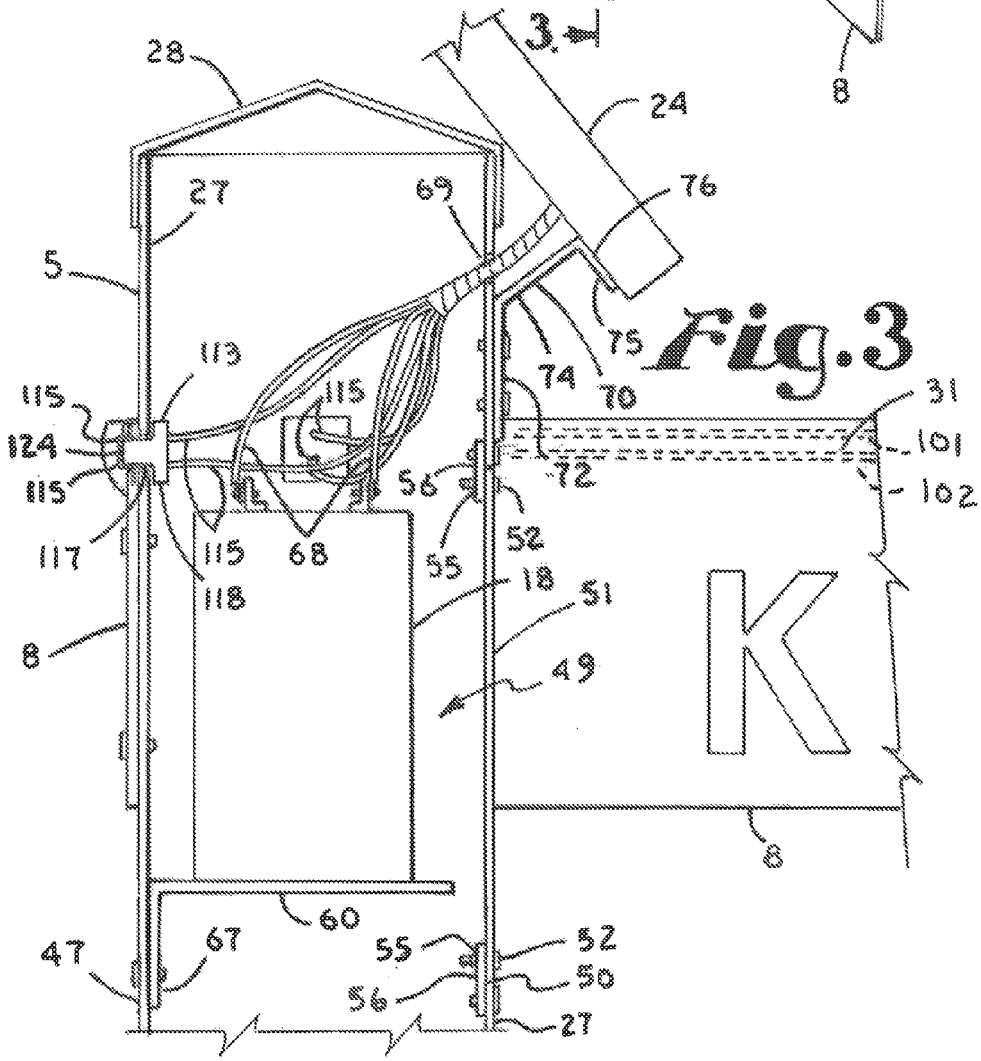
FIG. 3 is a cross-sectional view of the post taken along line 3-3 of FIG. 2.

In the embodiment shown in FIGS. 1-3, post 5 has a panel 8 attached to its back wall 47 and a panel 8 attached to side wall 48. Panels 8 can be attached at almost any location along the exterior of post 5, however it is preferable to attach panels proximate the upper end 30 of the post so the panels are easily visible to vehicles and pedestrians.

Sign 1 further comprises an integral electrical system which includes battery 18 installed within post 5. Battery 18 may be a rechargeable twelve volt sealed lead acid battery having approximate dimensions of four inches tall, three inches wide and three inches deep. Battery 18 has two terminals, one positive and one negative, located on top of the battery. The battery is installed in battery compartment 49 which is located in the interior hollow area of post 5 proximate upper end 30 of the post.

Battery compartment 49 is accessed through opening 50 on the front wall 46 of post 5. Opening 50 is generally concealed by cover 51 unless battery 18 is being replaced or the sign's electrical system is being serviced. Cover 51 is held in place over opening 50 by screws 52 which are routed through screw holes in the cover and threadingly engaged with threaded receivers 55. Threaded receivers 55 are located in tabs or brackets 56 which are riveted to the interior surface of the front wall 46 of post 5 at the top and bottom of opening 50 and extend toward the center of opening 50. In addition to receiving screws 52, brackets 56 serve as stops for cover 51 so that it does not fall through opening 50 and into battery compartment 49. Cover 51 is sized to fit snugly within opening 50 so that the cover 51 is flush with the exterior surface of front wall 46. A handle or pull (not shown) may be provided on cover 51 to assist in removal of the cover from the sign.

Battery 18 sits in battery compartment 49 on a platform 60. Integrally attached to the back of platform 60 is a mounting flange 67 extending downward at a right angle from the platform 60. Mounting flange 67 is placed against the interior surface of back wall 47 and riveted thereto so that platform 60 is horizontal within compartment 49. Mounting flange 67 has two rivet holes (not shown) aligned horizontally. Corresponding rivet holes (not shown) are located on the back wall 47 proximate the lower end of battery compartment 49 which generally aligns with the bottom of opening 50. Mounting flange 67 is attached to the back wall 47 by aligning the rivet holes in flange 67 with the corresponding holes on back wall 47 and inserting and upsetting a rivet in each hole. It is foreseen that a different quantity and configuration of rivets may be used to attach mounting flange 67 depending on the physical characteristics of post 5 and the weight being supported by flange 67. Care must be taken so that the rivets do not interfere with the mounting of a panel 8. Platform 60 is sized so that its width is slightly smaller than the width of opening 50 thus allowing the platform to be inserted through opening 50 for installation in compartment 49. When mounted on back wall 47, platform 60 extends away from the back wall 47 and across the battery compartment 49 to within approximately one half inch of opening 50.

The solar panel 24 for the electrical system of sign 1 is mounted proximate the top of post 5. Solar panel 24 comprises a collection of interconnected photovoltaic modules which are designed to convert solar energy or sunlight into electricity. Solar panel 24 generates electricity to charge battery 18 when the panel is exposed to sunlight. Therefore, for optimal operation of the solar panel 24, sign 1 should be mounted in a location which maximizes the amount of sunlight solar panel 24 receives. If sign 1 is mounted in an area that does not receive ample sunlight, such as in a tunnel or a heavily shaded area, solar panel 24 may not generate sufficient electricity to recharge battery 18.

Solar panel 24 is connected electrically to battery 18 through wiring 68. The electrically positive wire 68 attaches to the positive terminal on battery 18, and the electrically negative wire 68 attaches to the negative terminal on battery 18. The wires are routed from solar panel 24 to battery 18 through a wire opening 69 in post 5. The wire opening 69 is sealed with caulk or other weatherproofing to prevent moisture from entering the battery compartment 49.

Solar panel 24 is attached to post 5 by a bracket 70. Bracket 70 attaches to the lower back portion of solar panel 24 and also to post 5 above opening 50. Bracket 70 is attached to post 5 by riveting the mounting flange 72 of the bracket 70 to the post 5. Riveting is performed using a procedure similar to the steps of riveting a panel 8 or mounting flange 67. Typically four rivets oriented in a rectangular configuration are sufficient to attach and support solar panel 24 to post 5, however additional rivets may be used if necessary based on the weight of the solar panel. A supporting member or central web 74 of bracket 70 extends away from mounting flange 72 toward a panel engaging flange 75. The panel engaging flange 75 attaches to the lower back surface 76 of solar panel 24 by screws or other fasteners. As mentioned above it is desirable to maximize the amount of sunlight solar panel 24 receives, therefore the solar panel is typically tilted upward when mounted on post 5.

The electrical system of sign 1 also comprises a photocell switch (not shown) that is integral to solar panel 24 that automatically switches on and off electrical power from battery 18 to lights 16 based on ambient light proximate the sign. The photocell switch uses a light sensor 81 to identify the amount of ambient light around the sign, and when a predetermined level of ambient light is reached the switch activates or deactivates lights 16 as necessary. When light sensor 81 senses that it is sufficiently dark to require lights 16, the switch closes to allow battery 18 to provide power to the lights. When sensor 81 senses that it is sufficiently light outside and lights 16 are not needed, the photocell switch opens to stop battery 18 from providing power to the lights. The electrical system of the sign is designed such that, in general, during the daylight hours the lights 16 are off and the solar panel 24 generates electricity to charge battery 18, and during the nighttime hours battery 18 dispenses its charge to power lights 16.

Figure 4:
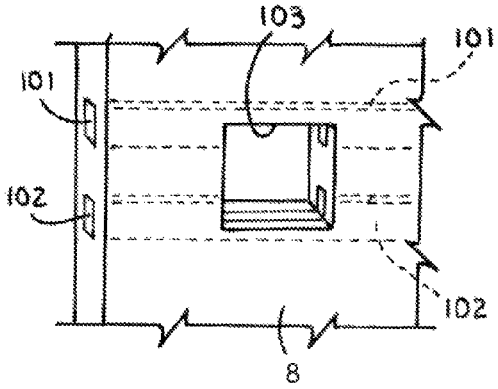
FIG. 4 is an enlarged portion of a sign panel having a hole formed therein to expose the conductors.

As best seen in FIG. 4, electrical conductors 101 and 102 may be embedded in and run the length of panel 8. Similarly, two pairs of electrical conductors 101 and 102 are preferably embedded in and run the length of top panel 36 on opposite sides thereof. The conductors 101 and 102 are preferably flattened and generally form an elongated cuboid. The conductors 101 and 102 carry low voltage DC current to power electrical apparatus such as lighting, speakers, weather sensors and the like mounted to panel 8 or top panel 36. In the preferred embodiment the conductors 101 and 102 are flattened so that the conductors are taller than they are wide relative to a vertically oriented panel in which they are embedded. The wire may also be referred to as a flattened wire or conductor and the wire does not have to be truly rectangular in cross-section. It is to be understood that the wire could have planar, parallel front and rear surfaces with rounded upper and lower edges. It is also foreseen that the wire could have an ovate cross-section. Using flattened wires 101 and 102 reduces the size of any bulges or the like formed by displacement of fiberglass material around the conductors 101 and 102.

Access to the conductors or wires 101 and 102 for electrically connecting an electrical apparatus thereto is accomplished by forming holes 103 through panel 8 or top panel 36 with the holes 103 extending between the two conductors 101 and 102 and exposing a sufficient portion of the conductors 101 and 102 to form an electrical connection thereto with conductors on the apparatus to be installed. The number of holes 103 can vary depending on the type and quantity of apparatuses being connected to panel. The apparatus to be installed may include lights 16 of the type disclosed in my prior U.S. Pat. No. 7,810,277, the disclosure of which is incorporated herein by reference. A typical sign installation may comprise a row of lights 16 proximate the top of panel 8, the lights 16 spaced apart at two and a half inch intervals. If indicia 33 are on both sides of panel 8, the lights 16 in the row may be arranged in an alternating fashion such that every other light 16 illuminates one side of the panel (as shown in FIGS. 1 and 2). A typical panel 8 may have seven to eleven lights 16 mounted thereon. Other quantities and arrangements of lights 16 are foreseen depending on the size and application of the sign 1.

For T-shaped displays 35, holes are formed in each overhang 40 and 41 of the top panel 36 between parallel spaced conductors 101 and 102. Lights 16 are mounted on top panel 36 on opposite sides of vertical panel 37 to shine downward and illuminate indicia 33 on both sides of the vertical panel 37.

Battery 18 supplies electrical power to the conductors 101 and 102 respectively using a power supply clip 113 and cap 114 (see FIG. 3) assembly similar to that shown in U.S. Pat. No. 7,810,277. Electrical wires or leads 115 are connected between solar panel 24 and conductors 101 and 102. Electrical power supplied by battery 18 to conductors 101 and 102 is routed through solar panel 24 so that the photocell switch can start or stop power to the conductors depending on the amount of ambient light present.

The power supply clip 113, as shown in FIGS. 3 and 9, includes a plug or plug shaft 117 and a face plate or plug flange 118 sized for insertion in one of the holes 103 to frictionally engage the portion of the panel surrounding the hole 103. The plug 117 is generally square in cross-section. Two bores 124 extend through the face plate 118 and plug 117 of clip 113.

An exposed portion of each lead 115 is bent back over and across an outer surface of the plug 117 and preferably at least up to a rear surface 130 of the face plate 118. The plug 117 is inserted in one of the holes 103 with the plug 117 oriented so that the exposed ends of leads 115 engage the conductors 101 and 102 so that the exposed ends of the leads 115 are pressed against and held in electrical contact with the conductors 101 and 102.

One of the caps 114 (of the type shown in FIGS. 5-7) is securable over the end of the plug 117 to help further secure the clip 113 in place on panel 8 or top panel 36. The cap 114 used for the power supply clip 113 may also be used for securing the lights 16 to panel 8 or top panel 36. Reference is therefore made to the drawings showing the lights 16 for details regarding the caps 114. Each cap 114 includes a receiver 133 which is square in cross-section and sized to receive the plug 117 in a friction fit. It is to be understood that a wide variety of other means could be utilized to connect electrical leads to the conductors 101 and 102 to supply electricity thereto. For example, the electrical connection may be made at the end of each panel 8 or 35.

Figure 5:
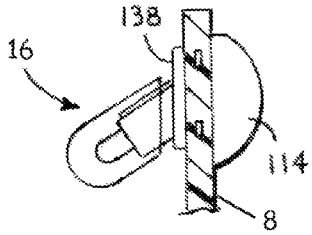
FIG. 5 is a fragmentary cross-sectional view taken generally along line 5-5 of FIG. 1.
Figure 6:
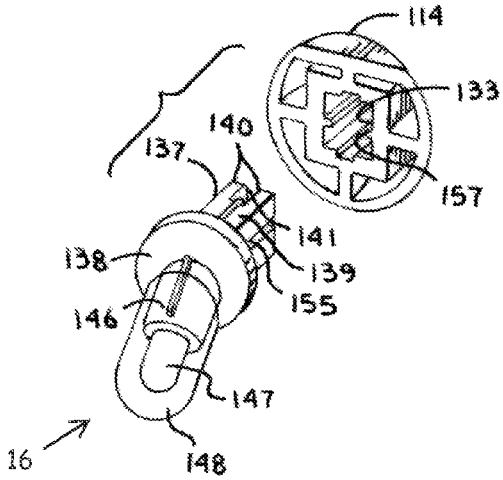
FIG. 6 is an exploded perspective view of a light and a cap used to secure the light in a hole in a panel of the sign in contact with conductors embedded therein.
Figure 7:
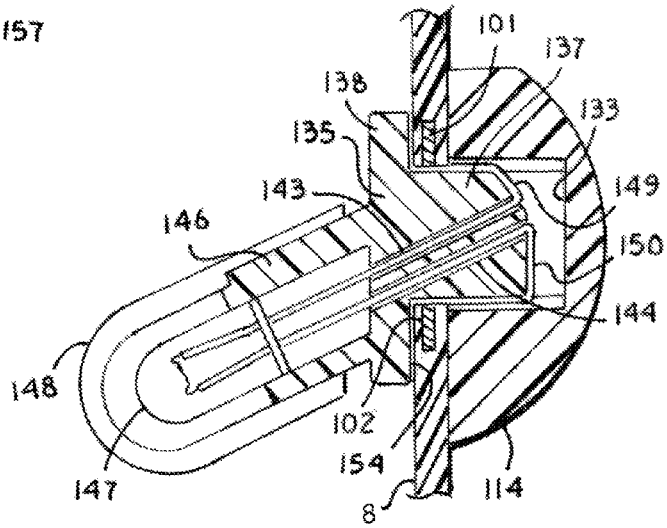
FIG. 7 is an enlarged fragmentary, cross-sectional view take generally along line 7-7 of FIG. 1.

The lights 16, an example of which is best seen in FIGS. 5-7, are constructed in a fashion similar to the clip 113. Each light 16 includes a body 135 including a plug or plug shaft 137 which projects rearwardly from a face plate or flange 138. The plug 137 is sized for insertion in one of the holes 103 to frictionally engage the portion of the panel surrounding the hole 103. The plug 137 is generally square in cross-section and includes a base 139 with a pair of rearwardly projecting legs or prongs 140 separated by a groove 141. Two bores 143 and 144 extend through the face plate 138 and plug 137 of light body 135. The bores 143 and 144 extend through base 139 of the plug 137 and open into the groove 121.

A bulb socket 146 is formed on faceplate 138 on a side opposite the plug 137, a light bulb 147 is secured within the socket 146 and a lens 148 covers the bulb 147 and socket 146. Electrical leads 149 and 150 extend from the light bulb 147 and through bores 151 and 152 in the in the face plate 138 and plug shaft 137 and back around sides of the plug 137 for engagement with the electrical conductors 101 and 102 when the plug 137 is inserted in one of the holes 103 in panel 8 or top panel 36. An exposed portion of each lead 149 and 150 is bent back over and across an outer surface of the plug base 139 and at least up to a rear surface 154 of the face plate 138. The plug 137 is inserted in one of the holes 103 with the plug 137 oriented so that the exposed electrical leads 149 and 150 engage the conductors 101 and 102 to form an electrical contact with the conductors 101 and 102.

A cap 114 is securable over the end of the plug 137 of each light 16 to help further secure the lights 16 in place on panel 8 or top panel 36. The cap 114 receiver 133 is sized to receive the plug 137 in a friction fit. The plug 137 preferably includes a groove 155 formed along the side of one of the legs 140. A mating guide or tongue 157 is formed in the cap receiver 133. The tongue 157 in cap receiver 133 extends into the aligned groove 155 formed in the leg 140 of plug 137 in a friction fit to further assist in securing the cap 114 to the plug 137.

The lightbulb 147 may be of a variety of types including incandescent or LED. The shape of the socket 146 and lens 148 may also vary and it is foreseen that the light could be mounted above the sign 1, with flexible leads connected to conductors 101 and 102 through a clip such as clip 113 or through a rigid mount.

The light bulb 147 and lends 148 for each light 16 may be angled relative to the face plate 138 and mounted on panels 8 or 36 so as to angle toward and direct light toward indicia 33 on front and rear faces 31 and 32 of panel 8 or front and rear faces of panel 36. Overhangs 40 and 41 also reflect light downward across front and rear faces 38 and 39 to enhance illumination of the indicia 33 thereon.

It is to be understood that while certain forms of the present invention have been illustrated and described herein, it is not to be limited to the specific forms or arrangement of parts described and shown.

The invention claimed is:

1. A street sign comprising:

first and second vertical panels for displaying indicia, said first and second vertical panels fabricated from a fiber reinforced resin, each of said first and second vertical panels having a front surface and a back surface, said indicia being displayed on at least one of said surfaces, each of said first and second vertical panels having first and second electrical conductors embedded therein and running continuously along said length of said respective first and second vertical panels between said front surface and said back surface;

at least one hole formed through each of said first and second vertical panels and sized and shaped to expose portions of said first and second electrical conductors;

lights securable to said first and second vertical panels, said light contacting said first and second electrical conductors and receiving electrical power through at least one of said conductors;

a vertical post for supporting said panel above ground level, said panel attached to the upper portion of said post such that said first and second vertical panels extend in perpendicular alignment;

a battery stored within said post; and a solar panel attached to said support, said solar panel for providing electrical power to said battery; and wherein said light comprises a light socket body with a plug projecting from an opposite end thereof; a light socket is formed in said light socket body and a light source is positioned in said light socket with a pair of electrical leads extending through said light socket body and said plug; said plug inserted through said at least one hole in said panel with said first and second electrical leads held in electrical contact with said exposed portions of said first and second electrical conductors respectively when said plug is inserted through said at least one hole.

2. The sign as in claim 1 further comprising a cap sized to be wider than said at least one hole and securable on said plug opposite said light socket body.

* * * * *